United States Patent [19]

McCoy

[11] 4,417,956

[45] Nov. 29, 1983

[54] ALKALINE PLATING BATHS AND ELECTROPLATING PROCESS

[75] Inventor: Ewald H. McCoy, Brookfield, Wis.

[73] Assignee: Electrochemical Products, Inc., New Berlin, Wis.

[21] Appl. No.: 426,005

[22] Filed: Sep. 28, 1982

Related U.S. Application Data

[60] Division of Ser. No. 169,752, Jul. 17, 1980, Pat. No. 4,356,067, which is a continuation-in-part of Ser. No. 48,265, Jun. 13, 1979, abandoned.

[51] Int. Cl.[3] ..... C25D 3/58

[52] U.S. Cl. ..... 204/44; 204/43 Z; 204/DIG. 2

[58] Field of Search ..... 204/DIG. 2, 43 Z, 44

[56] References Cited

U.S. PATENT DOCUMENTS

| | | | |
|---|---|---|---|
| 2,125,229 | 7/1938 | Harshaw et al. | 204/49 |
| 2,338,529 | 1/1944 | Mougey et al. | 204/49 X |
| 2,700,646 | 1/1955 | Chester | 204/44 |
| 2,730,492 | 1/1956 | Chester | 204/44 |
| 2,732,336 | 1/1956 | Ostrow | 204/44 X |
| 2,841,542 | 7/1958 | Manquen | 204/44 X |
| 3,111,465 | 11/1963 | Passal | 204/44 |
| 3,219,560 | 10/1961 | Leenders et al. | 204/52 |
| 3,642,591 | 2/1972 | Boose et al. | 204/55 R |
| 3,767,539 | 10/1973 | Clauss et al. | 204/52 R |

FOREIGN PATENT DOCUMENTS

| | | | |
|---|---|---|---|
| 2635560 | 11/1977 | Fed. Rep. of Germany . | |
| 486079 | 1/1976 | U.S.S.R. | 204/44 |

*Primary Examiner*—F. Edmundson
*Attorney, Agent, or Firm*—Quarles & Brady

[57] ABSTRACT

Cyanide-free plating baths for the electrodeposition of copper and zinc alloys comprise aqueous alkaline mixtures which contain copper and zinc ions and a chelating agent selected from glucoheptonic acid and its salts. Processes for electroplating using the bath and for removing the metal ions from the spent baths by pH adjustment are also disclosed.

6 Claims, No Drawings

ALKALINE PLATING BATHS AND ELECTROPLATING PROCESS

RELATED APPLICATION

The present application is a division of my earlier application U.S. Ser. No. 169,752 filed July 17, 1980, now U.S. Pat. No. 4,356,067, which was a continuation-in-part of my earlier application U.S. Ser. No. 48,265 filed June 13, 1979, now abandoned.

FIELD OF THE INVENTION

The present invention relates generally to the field of electroplating and more particularly to electroplating surfaces with copper and zinc alloys.

BACKGROUND OF THE INVENTION

Electroplating is a process for putting a metallic plate or coating on a conducting surface by using an electric current. The surface to be plated is connected to the negative end of a source of electricity and it is placed in a plating solution containing ions of the metal with which it is to be plated. The conducting surface to be plated when thus connected is referred to as the "cathode". The positive end of the electrical source is connected to another conductor which is of the same composition as the metal plate desired. It is commonly referred to as the "anode" and it is also placed in the plating bath. A direct electrical current is passed through the bath to separate metal ions from the plating bath and cause the metal to be deposited on the cathode.

Alkaline plating baths containing cyanide are employed for the commercial electrodeposition of copper and zinc alloys, such as, brass which contains approximately 70% copper and 30% zinc, white brass which contains 50% zinc and about 50% copper and high copper alloys which contain about 90% copper and 10% zinc.

The use of alkaline cyanide plating baths present spent bath disposal problems. Before the spent cyanide baths or subsequent rinses can be discarded, they must meet pollution control effluent requirements which requires costly cyanide destruction. Therefore, a need exists for a cyanide-free plating bath for the electroplating of copper and zinc alloys.

SUMMARY OF THE PRESENT INVENTION

The primary objects of the present invention are to disclose novel cyanide-free alkaline plating baths and a process for electrodepositing copper and zinc alloys from said baths.

It is another object of this invention to disclose plating baths for electrodepositing copper and zinc alloys in all proportions.

It is still another object of this invention to provide plating baths which permit copper and zinc alloys to be deposited directly on the copper, iron, steel and zinc alloys customarily used in industry without requiring a preliminary cyanide copper or nickel strike to insure adhesion.

It is a further object of the invention to disclose a plating bath and a process of electrodepositing copper and zinc alloys without the spotting of porous areas which can occur when a cyanide bath is employed.

It is also an object to disclose a process for simply and effectively removing the metal ions from a spent plating bath of the present invention.

Finally, it is an object of this invention to disclose an alkaline plating bath and process which makes unnecessary the costly cyanide destruction procedure which is required with conventional alkaline cyanide plating baths and their rinses for the effluent to meet pollution discharge requirements.

The novel plating baths of the present invention are aqueous mixtures containing a suitable source of the metal ions such as a mixture of copper and zinc salts, a chelating agent selected from glucoheptonic acid and its salts, which chelating agent is present in an effective amount which is in excess of the stoichiometric equivalent of at least one of the metal ions and sufficient base to render the mixture alkaline. The plating bath contains in each liter about 3.75 to about 15.0 grams of copper; about 1.25 to about 6.0 grams of zinc; about 10 grams to about 75 grams of the chelating agent and about 20 to about 37.5 grams of caustic and has a pH of about 10 to about 13.5. The mixture is preferably supplied as a bath concentrate which is diluted with 4 parts of water to yield the plating bath.

The process of the present invention for electrodepositing copper and zinc alloys basically comprises preparing a plating bath of the desired composition, connecting the conductive surface to be plated to the negative end of a source of electricity to form a cathode, placing the cathode in the plating bath, inserting into the bath an anode, which is of the same metal mixture as that which is to be deposited, and which is connected to the positive end of a source of electricity. When the cathode and anode are in place a direct current is passed through the bath to electrically deposit the metal alloy upon the cathode.

The excess metal ions are removed from the spent plating baths by introducing carbonate ions into the spent bath and reducing the pH of the bath to precipitate the metal and carbonate ions as a readily removable sludge.

Other objects and advantages of this invention will appear from the description which follows:

DETAILED DESCRIPTION OF THE PREFERRED EMBODIMENT OF THE INVENTION

In the preferred embodiment of the invention, the concentrate which is used to plate 70% copper and 30% zinc (brass) is an alkaline aqueous mixture having a pH of about 13.0 to about 13.5 which contains in each liter about 15 to about 60 grams of copper; about 5 to about 25 grams of zinc, about 80 to about 200 grams of KOH and about 40 to about 300 grams of the sodium salt of glucoheptonic acid as the chelating agent. The mixture is preferably supplied as a concentrate which is diluted with 4 parts of water to make the plating bath.

The plating solution after dilution has a pH of about 10 to 13.5 and may have the following composition:

| | Optimum | Range | |
|---|---|---|---|
| Copper | 6.75 grams/liter | 3.75-15.0 | grams/liter |
| Zinc | 2.25 grams/liter | 1.25-6.0 | grams/liter |
| Caustic (KOH) | 30 grams/liter | 20-37.5 | grams/liter |
| Chelating Agent | 50 grams/liter | 10-75 | grams/liter |

The plating solution is made up as follows:

The tank capacity is calculated (allowing for the filter and related heating equipment) and the quantity is divided by five. The resultant figure is the amount of concentrate required to make up the plating bath. This is added to the tank and water is added to near the final volume. One percent of a brightener Addition Agent is added (1 gal./100 gallons) of total volume. After a temperature check and a short electrolysis at 10 ASF the bath is ready for operation.

The preferred bath described above, requires either 70/30 bar anodes or titanium baskets with 70/30 ball anodes. Steel should not be allowed to come in contact with the plating solution as it will dissolve slowly under reverse current conditions.

Plating with the bath of the present invention requires a clean lined plating tank and related equipment. Rubber, Koroseal or other plastic tanks are suitable. When the bath is used in tanks that have previously been used for cyanide plating the tank, anodes, anode bars must be free of cyanide. After the removal of the old cyanide bath the equipment should be washed with hypochlorite solution and the tank soaked for 24 hours in 2% sodium hypochlorite to destroy all cyanide. Hoods, barrels, and filtering equipment must also be free of cyanide. After removal of the hypochlorite solution and rinsing, a dilute 1% to 2% sulphuric acid rinse should follow and after rinsing with water a 5% caustic rinse should be used to eliminate the acid. The caustic rinse should be removed and the concentrated solution added and diluted for use.

Control of the caustic content of the bath is the most frequent adjustment required. The caustic content should be checked daily and corrected (this takes place of the cyanide check in usual brass solutions). The analysis only takes minutes and should not be ignored. Control of the caustic is very important for anode corrosion. Liquid KOH is the preferred caustic because of ease of addition.

The metal content of the bath is replenished by adding the bath concentrate whenever the copper metal content decreases. Adding additional bath concentrate also adds caustic. Caustic adjustments should be made, if required, after a metal addition if analysis shows the caustic to be below the desired level. Adding concentrate automatically adjusts the other chemical components.

The amount of brightener agent to be added is determined by the ampere hours plated. One gallon of brightener solution is added for every 12–15,000 A/H. The additions should be made every 4 hours or by automatic feed for best and most economical results. A dark smutty deposit indicates a high brightener content (assuming bath composition is satisfactory) and a low concentration results in loss of proper yellow green brass color.

Determination of the copper and zinc ion levels is done by simple analytical procedures developed especially for the process.

The analytical procedures employed are the following:

(a) ZINC METAL

1. Place 10 ml sample in a 250 ml flask.
2. Add 50 cc deionized or distilled water.
3. Add ½ gram NaCN and swirl until completely dissolved. At this point, solution will be clear. (Let stand for 10 minutes)
4. Add a small amount of Eriochrome Black T Indicator (solution should be a bright pink color.)
5. Add 5 grams chloral hydrate and swirl vigorously for at least 30 seconds. While swirling, the solution will go from clear pink to a cloudy blue-violet to a clear red-violet color. Titrate immediately with 0.1 M EDTA.
6. Titrate to a blue color change—take reading quickly as the end point is fugitive.
7. Calculation: (mls of 0.1 M EDTA)×0.087=in Zn Metal.

(b) COPPER METAL

1. Place 5 ml sample in a 250 ml flask.
2. Add 50 cc deionized or distilled water.
3. Add 2 to 3 grams ammonium persulfate.
4. Add 5 mls ammonium hydroxide (conc.) (Let stand for 10 minutes.)
5. Add 10 drops pan indicator. (Do not add more than 10 drops as the end point is affected.)
6. Just before titrating add 5 grams chloral hydrate, swirl to dissolve crystals.
7. Titrate immediately with 0.1 M EDTA solution to an apple green end point. Calculation: [1.74×(mls of 0.1 M ESTA)] divided by 5, minus [2 times the zinc metal]×0.488=oz/gal Cu Metal.

(c) KOH

1. Place 5 ml sample in a 250 ml flask.
2. Add 10 mls deionized or distilled water.
3. Add 3 to 5 grams sodium cyanide and swirl, (solution should now be clear and pale green.)
4. Add 8 to 10 drops LaMotte Sulfo Orange Indicator and 1 or 2 drops Alkali Blue Indicator.
5. Titrate with 1.0 N HCl to a green end point. Color change is from a brown-orange to a green. Calculation: mls of 1.0 N HCl×1.5=oz/gal KOH The solutions required for analytical procedures are the following:

(a) Eriochrome Black T Indicator

Weigh out 1.0 gram of Eriochrome Black T Powder available from:

LaMont Laboratories
P.O. Box. 30632
Dallas, TX 75230

Weigh out 100.0 grams of Sodium Chloride and mix thouroughly with the Eriochrome Black T Powder.

(b) Pan Indicator

Weigh out 0.1 gram of 1-(2-Pyridylazo-Napthol) and dissolve in 100 mls of denatured alcohol.

(c) EDTA (0.1 Molar)

On analytical balance weigh out 37.2398 grams of EDTA (Ethylenediamine-tetra-acetic acid, disodium salt). Dilute to 1000 mls with deionized or distilled water in a volumetric flask. Allow this solution to stand over night. EDTA crystals should be completely dissolved.

(d) HCl (1.0 N)

Measure out 83 mls of concentrated hydrochloric acid into 900 mls of deionized or distilled water. Using a 1000 ml volumetric flask dilute to the mark with deionized or distilled water. Let stand for a day. Standardize the solution.

The copper and zinc ions in the bath may be supplied by using water soluble salts such as the sulfate, chloride, fluoroborate, fluorosilicate and fluoride. Other copper and zinc compounds which can be used include carbonates, phosphates, pyrophosphates, hydroxides and zinc oxide. Especially preferred for use are the mono or polycarboxylic aliphatic acid salts or mono or polyhydroxy aliphatic acid salts of the metals. Such salts are not generally available in large enough quantities to allow their commercial use, however they can be formed in situ. It is well known that as long as the metal ions are present, i.e. copper and hydroxide for example, and an organic acid such as acetic acid is introduced that the resultant reaction produces the carboxylic aliphatic acid salt of copper and water. Likewise, a mixture of zinc carbonate and lactic acid reacts in a aqueous solution to provide zinc lactate and carbonic acid. The carbonic acid breaking down to form $CO_2$ and water. Therefore, rather than purchase the metal salts as mono or polycarboxylic aliphatic acid salts or mono or polyhydroxy aliphatic acid salts, it is preferred to mix the metal salts with the proper amount of either type of organic acid and form the desired metal organic complex.

Generally speaking, any salt can be used to supply the metal ions which does not contain other ions which interfere with the electroplating process. For example, copper and zinc chromates or cyanides would not be suitable as sources of the metal ions, as the chromate would inhibit the metal deposition and the cyanides would introduce cyanide ions into the plating bath and defeat an important purpose of the invention.

The mixture of copper and zinc salts employed may have copper to zinc ion ratios ranging from 99 to 1 to 1 to 99. The ratio to be used will depend upon the nature and properties of the alloy desired to be deposited. There seems to be no limitation on the ratios of the metals in the mixtures that can be deposited using the baths of the present invention.

The chelating agents which can be used in the practice of the present invention are glucoheptonic acid and its alkali metal salts. Although the sequestering or chelating abilities of the glucoheptonic acid and its salts has been known for some time, such compounds have only been used in the past in plating baths in relatively small amounts to chelate undesirable metal ions introduced by impurities or as a means of chelating small amounts of desirable metals used as grain refiners and brighteners. In the baths of the present invention the chelating agents are used in much higher quantities which maintain in the bath a reservoir of metal ions of sufficient concentration to permit the electrodeposition of the particular metal over a wide range of operating conditions. For this purpose it is necessary that the plating bath contain an amount of chelating agent which is in excess of a stoichiometric equivalent of at least one of the metals and preferably the copper. The preferred chelating agent is the sodium salt of glucoheptonic acid (sodium 1,2,3,4,5,6, hexahydroxy hexane-1-carboxylate). If desired, the bath may contain additional chelating agents.

Representative plating bath formulations of the present invention are the following:

| | |
|---|---|
| COPPER/ZINC ELECTROLYTE RATIO 90:10 | |
| $CuSO_4$ | 10 g/L |
| $ZnSO_4$ | 1 g/L |
| $CH_2OH(CHOH)_5COONa$ | 20 g/L |
| NaOH | 40 g/L |
| COPPER/ZINC ELECTROLYTE RATIO 70:30 | |
| $CuCO_3.Cu(OH)_2$ | 15 g/L |
| $ZnCO_3$ | 5 g/L |
| $CH_2OH(CHOH)_5COONa$ | 50 g/L |
| KOH | 35 g/L |
| COPPER/ZINC ELECTROLYTE RATIO 50:50 | |
| $Cu(CH_3COO)_2$ | 20 g/L |
| Zinc Oxalate | 16 g/L |
| $CH_2OH(CHOH)_5COONa$ | 30 g/L |
| LiOH | 45 g/L |

The electrodeposition of the copper and zinc alloys over a wide range of temperatures using the above formulations was evaluated. As a result it was found that the metals could be deposited at temperatures ranging from approximately 20° C. to 65° C. The high temperatures were found to be more suitable for high copper alloys and the lower temperatures more suitable for the higher zinc alloys. However, for most purposes a temperature range of 30° C. to 50° C. provides a range in which all alloys may be codeposited depending upon bath composition and other operating conditions.

The bases that may be used to adjust the pH of the plating baths are preferably the alkaline metal hydroxides of sodium, potassium and lithium. The use of ammonium hydroxide is not recommended because it does not increase the pH to the level required for successful operation of the inventive process. In addition, ammonium hydroxide is difficult to remove as the copper complex from the effluent in the pollution treatment process. In addition to the alkaline metal hydroxides, amines also may be used but they also can cause difficulties in the subsequent pollution treatment process.

A convenient process for removing metal ions from a spent bath of the present invention involves introducing carbonate ions into the spent bath. When carbonate ions are added to the spent bath and the pH of the bath is reduced to about 8.5, a reduction in chelating power causes the remaining metal ions to precipitate as carbonates allowing for their easy removal as sludge. This facilitates upgrading the effluent without requiring the usual costly cyanide destruction process which is required with alkaline cyanide baths. The organic ions which remain are carboxylic aliphatic acid salts which are relatively nontoxic. Many of them are contained in large quantities in natural foods or are added to prepared foods to provide desired characteristics or maintain quality and freshness.

In the process of plating objects, which employs the previously described plating baths, the object to be plated is connected to the negative end of a source of electricity as the cathode and an anode of the desired metal or metal alloy is connected to the positive end of the electrical source. A direct current is then passed through the solution resulting in an electrodeposit of a uniform plate or layer of metal upon the cathode.

The tank voltages and amperages used in the process are similar to those used on cyanide processes; 2–6 volts on tank operations and 9–12 volts on barrel operations. The plating is preferably conducted at 100° F., with either mild air or cathode agitation in the tank or barrel agitation at 2–6 RPMs. For best results filtering must be continuous for smooth plating and the filter should be lined or of non-metallic construction. Ventilation is required because of the caustic nature of the solution.

The plate of alloy obtained through practice of the invention is uniform and acceptable for many purposes, however, it may be duller in appearance than desired. If so, a bright, smooth uniform deposit which may be more commercially desirable can be obtained by adding conventional brightening agents to the plating bath.

Among the compounds which have been found to enhance the brightness of the deposited metal plate are the following which normally would be used with a suitable wetting agent.

(a) The metal ions of antimony, cadmium, lead, selenium and tellurium. These have the greatest brightening effects. They may be used alone or in combination with each other. Quantities employed may range from 0.1 to 10.0 ppm.

(b) The ions of cobalt, nickel and molybdenum have a lesser but still beneficial effect and may be used in larger quantities to augment the first group. The effective range being 1 to 15 ppm.

(c) The ions of some of the precious metals such as indium, gold, or silver can be used but their cost precludes their practicability and their effect is not as great as those first mentioned. Effective concentration of the precious metal ions is in the range of 1 to 10 ppm.

It also has been found, that in addition to the aforementioned metal ions certain organic substances such as aldehydes act in a cooperative manner with the desirable trace metal ions to enhance the electrodeposit. Aldehydes such as anisaldehyde, benzaldehyde, crotonaldehyde, veratraldehyde etc., in face, any aldehyde or compound containing a carbonyl group which is capable of producing a smoothening and brightening effect in a commercial zinc plating process, appears to be capable of promoting brightness in cooperation with the metal ions mentioned in the preceding paragraphs. The quantity of compound required varies from 0.01 g/L to about 0.25 g/L and may vary with the compound selected. The aldehyde used may be added as the bisulfite adjunct or added dissolved in a suitable organic solvent, such as alcohol, glycol or a commercial solvent such as methoxy-ethanol, ethoxy-ethanol, etc.

The above described carbonyl group containing compounds may be used along with small amounts of sulphur containing compounds to further enhance brightness. Compounds having mercaptan groups (C—SH) and the C=S groups are very effective as auxiliary brightening agents when used in the process. Examples of compounds having mercaptan groups include dl homocystine (2-amino, 4-mercaptobutyric acid), 2-mercaptoethanol, and 2-mercaptobenzimidazole. Examples of useful compounds having the C=S group include cystine, and dl homocystine.

Other sulphur bearing compounds which showed brightening effects with less effectiveness were thiobenzanilide, 5-sulfosalicylic acid and sulfamide. These compounds are preferably used in amounts of 0.1 to 5 ppm as auxiliary brighteners.

The copper and zinc alloy plating baths can include any or all of the addition agents mentioned and they may be added as water soluble compounds.

A typical addition for a 90:10 copper and zinc deposit would be:

| | |
|---|---|
| Tellurium | 7.0 ppm |
| Lead | 3.0 ppm |
| Cobalt | .05 ppm |
| Benzaldehyde | .15 g/L |

A typical brightener system for a 70:30 copper/zinc deposit would be:

| | |
|---|---|
| Tellurium | 10.0 ppm |
| Antimony | 2.0 ppm |
| Nickel | 5.0 ppm |
| Selenium | .1 ppm |
| Anisaldehyde | .1 g/L |

A typical brightener system for a 50:50 copper/zinc deposit would be:

| | |
|---|---|
| Tellurium | 5.0 ppm |
| Lead | 1.0 ppm |
| Cadmium | 10.0 ppm |
| Veratraldehyde | .075 g/L |

A typical brightener system for a 10:90 copper/zinc deposit would be:

| | |
|---|---|
| Tellurium | 3.0 ppm |
| Lead | 1.0 ppm |
| Cobalt | 5.0 ppm |
| Benzaldehyde | .10 g/L |

The use of lead and tellurium or antimony and tellurium must be used in the brightener for grain refinement and smoothening effects.

The use of the auxiliary sulphur compounds to give additional brightness is accomplished by adding them to the plating bath in quantities of 0.1 to 2 ppm.

My discovery of the plating baths of the present invention is a significant advance in the field of electroplating because the baths make possible the economical commercial plating of copper and zinc alloys of commercially acceptable quality without the use of baths containing cyanide ions or special equipment. The plating baths may be used for barrel plating, or with air or cathode rod agitation for rack plating heavy brass. Ball burnishing of the plate is required for a bright, barrel finish or, it may be oxidized to obtain brushed finishes.

In addition, my plating baths provide all the advantages previously obtained only with cyanide baths without the pollution control problems associated with the use of such cyanide baths. Furthermore, my baths make it possible to deposit copper and zinc alloys directly on the copper, iron and zinc alloys customarily used in industry without the need for a preliminary copper cyanide strike to improve adhesion. Still further, my plating baths when used in the place of cyanide baths avoid the problem of cyanide spotting of porous areas.

The use of my plating baths also provides significant energy savings over the use of alkaline cyanide baths because there is no need when using my baths to destroy the cyanide ions. The spent baths of the present invention are simply adjusted to a pH of 8.5, the solution is treated with slaked lime, and sodium polysulfide is added to precipitate the remaining metals. The resulting effluent can be disposed of conventionally.

I claim:

1. A brightener for a cyanide-free electroplating bath for brass, said brightener being selected from metal ions consisting of antimony ions, cadmium ions, lead ions, selenium ions, tellurium ions, cobalt ions, nickel ions and molybdenum ions, and organic substances selected from aldehydes, compounds having carbonyl groups, compounds having C—SH groups, compounds having C=S groups, thiobenzanilide, 5-sulfosalicyllic acid and sulfamide.

2. A brightener of claim 1 which contains lead and tellurium ions.

3. A brightener of claim 1 which contains antimony and tellurium ions.

4. A brightener of claim 1 which contains tellurium, lead and cobalt ions and an aldehyde.

5. A brightener of claim 1 which contains tellurium, antimony, nickel and selenium ions and an aldehyde.

6. A brightener of claim 1 which contains tellurium, lead and cadmium ions and an aldehyde.

* * * * *